US006367384B1

(12) United States Patent
Cass

(10) Patent No.: US 6,367,384 B1
(45) Date of Patent: Apr. 9, 2002

(54) PROCESS FOR APPLYING 4 COLOR IMAGE TO A FISHING LURE

(75) Inventor: Donald Wayne Cass, Wagoner, OK (US)

(73) Assignee: Illusion Lures, Inc., Norman, OK (US)

( * ) Notice: Subject to any disclaimer, the term of this patent is extended or adjusted under 35 U.S.C. 154(b) by 0 days.

(21) Appl. No.: 09/515,352

(22) Filed: Feb. 29, 2000

(51) Int. Cl.[7] ..... B41C 33/00
(52) U.S. Cl. ..... 101/483; 101/41
(58) Field of Search ..... 101/41, 42, 43, 101/44, 35, 483

(56) References Cited

U.S. PATENT DOCUMENTS 3,811,915 A * 5/1974 Burrell et al. ..... 117/45
3,868,902 A 3/1975 Bradshaw et al. ..... 101/44
4,479,429 A 10/1984 Haryu ..... 101/38 A
4,774,885 A 10/1988 Chmielnik ..... 101/170
5,251,395 A 10/1993 Wicklund ..... 43/42.25
5,858,494 A 1/1999 Cherkas et al. ..... 428/40.1
6,132,043 A * 10/2000 Atkins et al. ..... 351/162

* cited by examiner

*Primary Examiner*—Ren Yan
(74) *Attorney, Agent, or Firm*—Molly D. McKay

(57) ABSTRACT

A process for printing a 4 color image directly onto a fishing lure. The process involves preparing the fishing lure to receive the ink if the fishing lure is soft bait, printing a 4 color image on one side of the fishing lure employing a 4 color pad printing machine, and optionally, turning the lure over and printing another 4 color image onto the other side of the lure with the 4 color pad printing machine. A clear topcoat may optionally be applied to the lure.

3 Claims, 1 Drawing Sheet

PROCESS FOR APPLYING 4 COLOR IMAGE TO A FISHING LURE

BACKGROUND OF THE INVENTION

1. Field of the Invention

The present invention relates to a process for applying 4 color image to a fishing lure by using a 4 color printing machine to print a color image onto a fishing lure.

2. Description of the Related Art

The current methods for applying images to fishing lures include painting the image onto the lure, using dye to color the lure, applying a paper containing an image onto a lure or inside a transparent lure, applying holographic foil to the outside of a lure or to the inside of a transparent lure or applying pre-printed decals to a lure. Some of these methods do not produce a realistic looking image of a fish onto the lure, and some of these methods involve applying an image to a piece of paper, foil or decal and then applying that piece of paper, foil or decal to the fishing lure. None of the current methods produce a realistic image directly onto a fishing lure. The present invention addresses this problem by printing an actual image of a fish directly onto a lure.

SUMMARY OF THE INVENTION

The present invention is a process for printing a 4 color image directly onto a fishing lure. The process involves preparing the fishing lure to receive the ink if the fishing lure is soft bait, printing a 4 color image on one side of the fishing lure employing a 4 color pad printing machine, and optionally, turning the lure over and printing a 4 color image onto the other side of the lure with the 4 color pad printing machine.

DETAILED DESCRIPTION OF THE PREFERRED EMBODIMENT THE INVENTION

Figure 1:
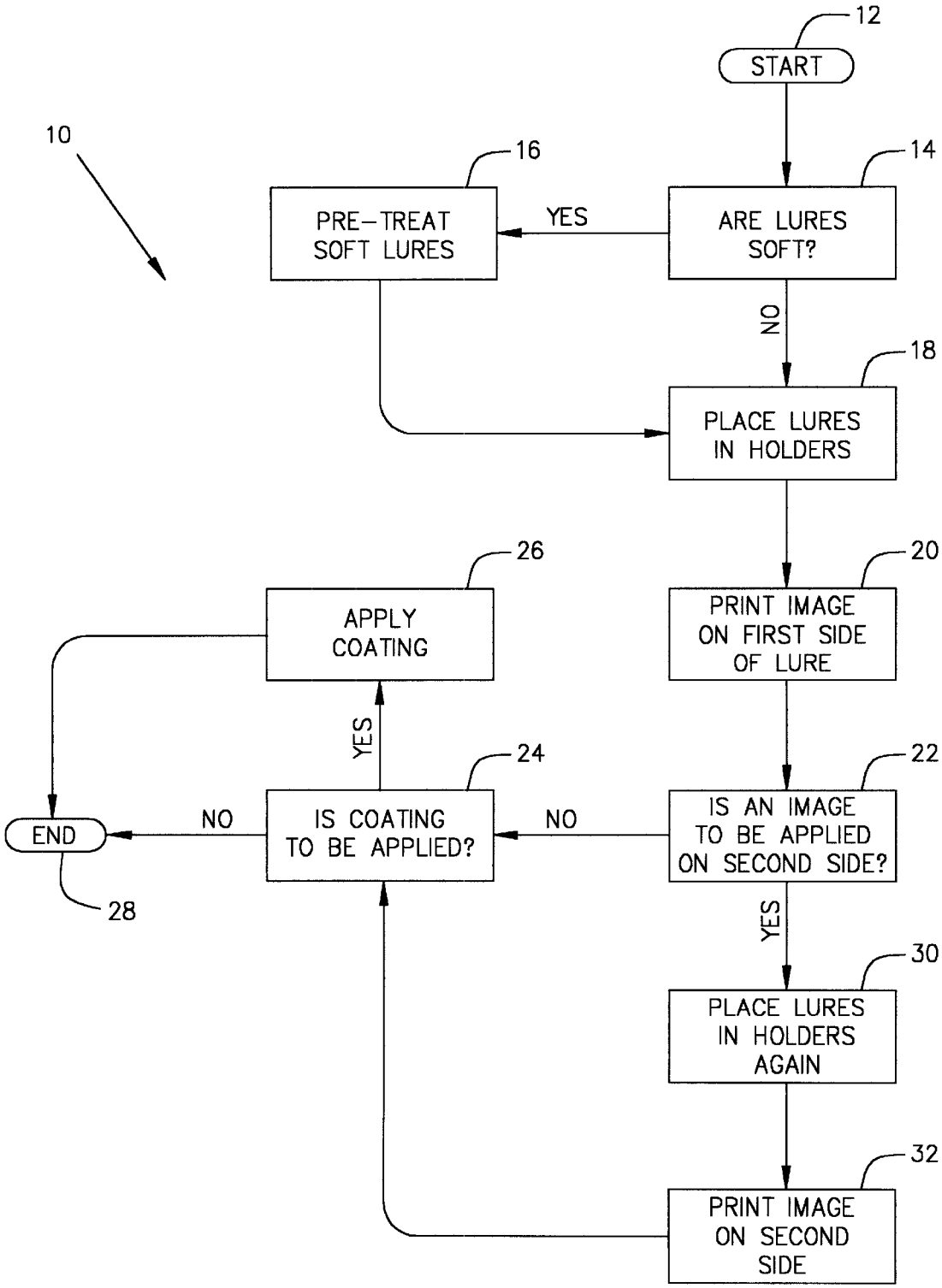
FIG. 1 is a diagram showing the process according to a preferred embodiment of the present invention by which a 4 color image is applied to a fishing lure.

Referring now to FIG. 1, a diagram of a process 10 for applying an image to a fishing lure according to a preferred embodiment of the present invention is shown. The process starts, as indicated by numeral 12 located at the top of FIG. 1. The first step in the process, as indicated by box 14 is to determine whether the lure that an image is to be applied to is a soft lure. Soft lures, i.e. those that are made of soft plastic, plastisol, or rubber must be pretreated, as indicated by box 16, prior to receiving a printed image. Although any type of soft lure can be used, Applicant has obtained good results with plastisol fishing lures available from Jaw Tec, Inc. located at P.O. Box 1181, Forney, Tex. 75126.

Soft lures are pretreated with a mixture of approximately 40% by volume of methyl ethyl ketone (MEK) and approximately 60% by volume isopropyl alcohol. Soft lures are soaked in the MEK/alcohol mixture for approximately 5–10 minutes, then removed from the mixture and allowed to air dry. Too high a proportion of MEK or soaking the soft lures too long can cause the soft lures to shrink.

After the soft lures have been treated and dried, or if the lures are hard lures, such as wood or hard plastic, the lures are then placed on their side into holders that rotate stepwise through a 4-color pad printing machine, as illustrated by box 18 in FIG. 1. Any 4-color printing machine may be employed; Applicant has employed a printing machine that is available from Imtran located at 25 Hale Street, Newbury Port, Mass. 01950.

The 4 color pad-printing machine is used to print an image onto the lures. Four printing clichés or positive printing plates were previously prepared in a dark room for each of the computer-generated images. This is done by first scanning the image of a real fish or a photograph of a real fish into a computer. If an image is to be applied to only one side of the lures, only one image, i.e. an image of one side of the real fish, is scanned into the computer. If images are to be applied to both sides of the lures, two images, i.e. images of both sides of the real fish, are scanned into the computer. Once the desired image or pair of images have been scanned into the computer, the computer is used to adjust the size of the images in order to match the size of the lures onto which the images are to be applied, and is used to create the negatives that are used to make the four cliches or positive plates for each image that are employed by the 4 color pad printing press. The process by which the cliches or positive plates are created is not discussed in detail herein since this process is well known in the art.

Once the four cliches are created, they are secured to the 4 color pad printing machine so that each cliches is used to supply the image for its associated ink color, i.e. either magenta, cyan, yellow or black. A printing pad on the printing machine kisses its associated cliché and receives a single color image from the cliché that the pad then transfers to the lure. This process is repeated four times, with four different cliches, four different pads, and four different colors of ink. Either flat or hollow printing pads may be used, although the hollow pads have been found to produce a better image on the convex surfaces of lures.

As illustrated by box 20 in FIG.1, once the lures have been placed on their sides into holders, the 4-color pad printing machine is activated and the holders move the lures through the printing machine where a 4 color image is printed o to the first side of the lures from pads that transfer the image from the four cliches to the lures. The final step in the printing process is that the ink is dried by heated air before the lures are ready to be removed from the holders.

As illustrated by box 22, after an image has been applied to the first sides of the lures, a decision must be made on whether an image is to be applied to the second side. If an image is not to be applied to the second side of the lures, a decision must be made on whether a clear coating is to be applied to the lures, as illustrated by box 24. If a coating is to be applied, the lure is coated with a clear topcoat, as illustrated by box 26 and the process is completed, as illustrated by box 28. Clear top coatings of various kinds may be employed. The coating should be selected based on the properties desired in the final product. Alternately, if no coating is to be applied, the process if also complete, as indicated by box 28.

Alternately, if the decision in box 22 is that a second image is to be applied to the second side of the lures, then a new set of four cliches for the new image must be inserted in the printing machine as replacements for the cliches from the previous image. The lures are then placed on their first side into the holders on the printing machine, as illustrated by box 30. The printing machine is once again activated, and a second image is applied to the second sides of the fishing lures by the printing machine, as illustrated by box 32, similar to the manner n which the image was applied to the first sides of the lures.

Once images have been applied to both sides of the lures, a decision is made or whether a clear coating is to be applied to the lures, as illustrated by box 24. If a coating is to be applied, the lure is coated with a clear topcoat, as illustrated by box 26 and the process is completed, as illustrated by box 28. Alternately, if no coating is to be applied, the process if also complete, as indicted by box 28.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A process for applying 1 color image to a fishing lure comprising the following steps:

a. soaking a soft lure in a solution of approximately 20% methyl ethyl ketone and approximately 80% isopropyl alcohol for between 5 and 10 minutes and allowing it to dry after the lure is removed from the solution, b. placing the lure on its side in a holder of a 4 color pad printing machine, and c. activating the printing machine to apply a 4 color image onto a first side of the lure.

2. A process according to claim 1 further comprising the following steps that occur after step c:

d. placing the lure on its first side in the holder, and e. activating the printing machine to apply a second 4 color image onto a second side of the lure.

3. A process according to claim 2, further comprising the following step that occurs after step e:

f. coating the lure with a clear topcoat.

* * * * *